US006131513A

United States Patent [19]

Emery

[11] Patent Number: 6,131,513

[45] Date of Patent: Oct. 17, 2000

[54] PRINTING PRESS WITH SIMPLE LOCK-UP PLATE CYLINDER

[75] Inventor: David Crowell Emery, York, Me.

[73] Assignee: Heidelberger Druckmaschinen AG, Heidelberg, Germany

[21] Appl. No.: 09/178,226

[22] Filed: Oct. 23, 1998

[51] Int. Cl.[7] ..... B41F 27/12

[52] U.S. Cl. ..... 101/415.1; 101/378

[58] Field of Search ..... 101/415.1, 378

[56] References Cited

U.S. PATENT DOCUMENTS

| | | | |
|---|---|---|---|
| 3,016,010 | 1/1962 | Luehrs | 101/415.1 |
| 3,727,551 | 4/1973 | Kostas et al. | 101/415.1 |
| 4,495,865 | 1/1985 | Kamoda | 101/415.1 |
| 4,510,868 | 4/1985 | Fischer | 101/415.1 |
| 5,062,363 | 11/1991 | Reichel | 101/415.1 |
| 5,644,984 | 7/1997 | Puschnerat et al. | 101/415.1 |
| 5,692,443 | 12/1997 | Reutter | 101/415.1 |
| 5,749,298 | 5/1998 | Castelli et al. | 101/415.1 |

FOREIGN PATENT DOCUMENTS

| | | |
|---|---|---|
| 44 15 622 | 11/1995 | Germany . |
| 196 42 141 | 6/1998 | Germany . |

*Primary Examiner*—Kimberly Asher
*Assistant Examiner*—Leslie J. Grohusky
*Attorney, Agent, or Firm*—Kenyon & Kenyon

[57] ABSTRACT

A printing press comprising a plate cylinder having an outer circumferential surface having an axially-extending slot therein, the slot having a first side and a second side, the plate cylinder having an axially-extending hole at least partially opening along the first side and having a hole axis. A printing plate has a lead edge and a tail edge, the lead edge and tail edge being located in the slot, and the plate cylinder has an eccentric shaft situated in the hole. The eccentric shaft is for eccentric rotation with respect to the hole axis so as to selectively provide a force against the lead edge and tail edge.

12 Claims, 2 Drawing Sheets

PRINTING PRESS WITH SIMPLE LOCK-UP PLATE CYLINDER

FIELD OF THE INVENTION

The present invention relates generally to printing presses, and more particularly to a plate cylinder of a printing press.

RELATED TECHNOLOGY

In printing presses, including direct and offset presses, plate cylinders often are used to carry a printing plate with an image to the plate cylinder. The ends of the plate are fit into an axially-extending slot and fastened there by a locking mechanism. The locking mechanism for the plate often is a complicated and expensive apparatus to firmly lock the plate cylinder in place. A gap on the outer surface of the plate results where the two ends are inserted into the slot. It is desirable to have this gap made as small as possible to reduce vibrations and to eliminate paper waste.

German Patent Application No. 44 01 201 A1, for example, shows a cylinder for holding a plate. The ends of the plate are inserted into a slot and fastened there by a locking mechanism which includes a pressurizable tube. When the tube is pressurized, for example by air, a force is exerted on the ends so as to hold the ends of the plate in place. However, such pressurized tubes may leak or fail over time.

German Patent Application No. 195 33 178 A1, for example, has ends of the printing plate placed in a slot in a plate cylinder. A locking mechanism includes a spring actuated element which is used to provide a force to hold the plate firm during operation. The locking mechanism however is complicated and requires several different parts which may be difficult to manufacture and service.

German Patent Application No. 44 15 621 A1, for example, also shows a spring actuated locking mechanism for holding ends of a printing plate in a slot of a plate cylinder. Embodiments in FIGS. 1 and 2 show different spring-actuation elements for contact the ends of the printing plate and holding them in place. This device may also malfunction or not function properly, as springs may lose their effectiveness over time and at least two locking mechanism components are necessary.

SUMMARY OF THE INVENTION

The present invention provides a printing press comprising a plate cylinder having an outer circumferential surface having an axially-extending slot therein, the slot having a first side and a second side, the plate cylinder having an axially-extending hole at least partially opening along the first side and having a hole axis; a printing plate having a lead edge and a tail edge, the lead edge and tail edge located in the slot; and an eccentric shaft situated in the hole, the eccentric shaft for eccentric rotation with respect to the hole axis so as to selectively provide a force against the lead edge and tail edge. The present invention also provides the plate cylinder as described.

Preferably, the present invention also includes a wrench or a tool attached to the shaft for rotating the shaft. The shaft may be activated either manually or automatically.

Advantageously, the eccentric shaft according to the present invention also may have various surface finishes depending upon the desired frictional relationship between the lead or trail edge and the shaft. Another embodiment of the present invention is a shaft having finger-like projections at each end. The finger-like projections can serve to grab the tail edges and pull the lead and the tail edges into a cylinder. The finger-like projections preferably have a profile which minimizes the stress on the cylinder plate. Reduction of stress on the cylinder plate can prevent or minimize ripping or tearing of the lead and/or tail edges.

Advantageously, the eccentric shaft may also have various lock-downs at each or one end to aid in holding the shaft in place, for example in a plurality of fixed rotational positions. The possible lock-downs includes clamps, additional eccentrics, toggle laches, etc.

BRIEF DESCRIPTION OF THE DRAWINGS

In the following, the present invention is explained in more detail with the aid of the drawings, in which.

DETAILED DESCRIPTION

Figure 1:
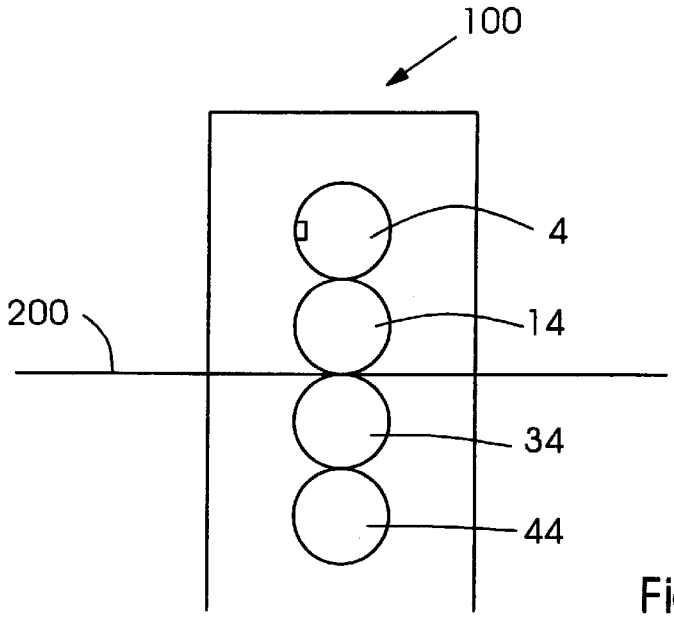
FIG. 1 shows a printing press of the present invention.

FIG. 1 illustrates schematically an offset printing press 100 with a first plate cylinder 4, a first blanket cylinder 14, a second blanket cylinder 34 and a second plate cylinder 44. The first plate cylinder 4 and second plate cylinder 44 carry printing plates with images for transfer to a web 200 through the respective blanket cylinders. It should be noted that one or both of the plate cylinders 4, 44 may be made as described in more detail below. In addition, the present invention is equally applicable to direct printing presses or sheet-fed presses.

Figure 2:
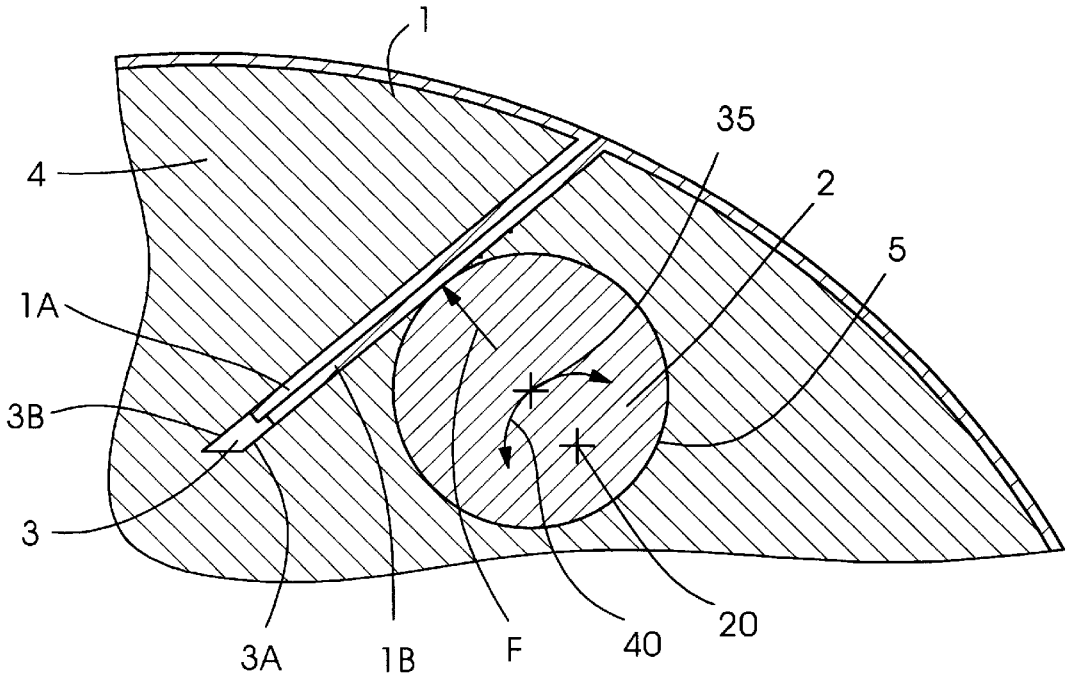
FIG. 2 shows partially an embodiment of the present invention having an eccentric shaft inside a plate cylinder.

FIG. 2 illustrates a plate 1 of the printing press 100, the plate 1 having a lead edge 1A and a tail edge 1B situated on a plate cylinder 4. The plate cylinder 4 has a plate slot 3. The lead edge 1A and the tail edge 1B are situated in the plate slot 3, which has a first side 3A and a second side 3B. An eccentric shaft 2 has an eccentric axis 20 eccentric to a hole axis 35. The shaft 2 is disposed within a hole 5 of the plate cylinder 4, and is preferably disposed near the plate slot 3 having the lead and tail edges 1A, 1B. The shaft 2 can be activated to move or rotate, manually or automatically, by a tool or a wrench indicated schematically by the number 40. The tool or wrench is attached to one or both ends of the eccentric shaft 2. The shaft 2 can rotate clockwise or counter-clockwise to apply a pressure to the lead and tail edges 1A, 1B. This pressure assists the lead and tail edges 1A, 1B from unwanted movement and error free printing by the plate. This pressure also helps prevent the lead and tail edges 1A, 1B from exiting the plate slot 3 during high rotations.

Figure 3:
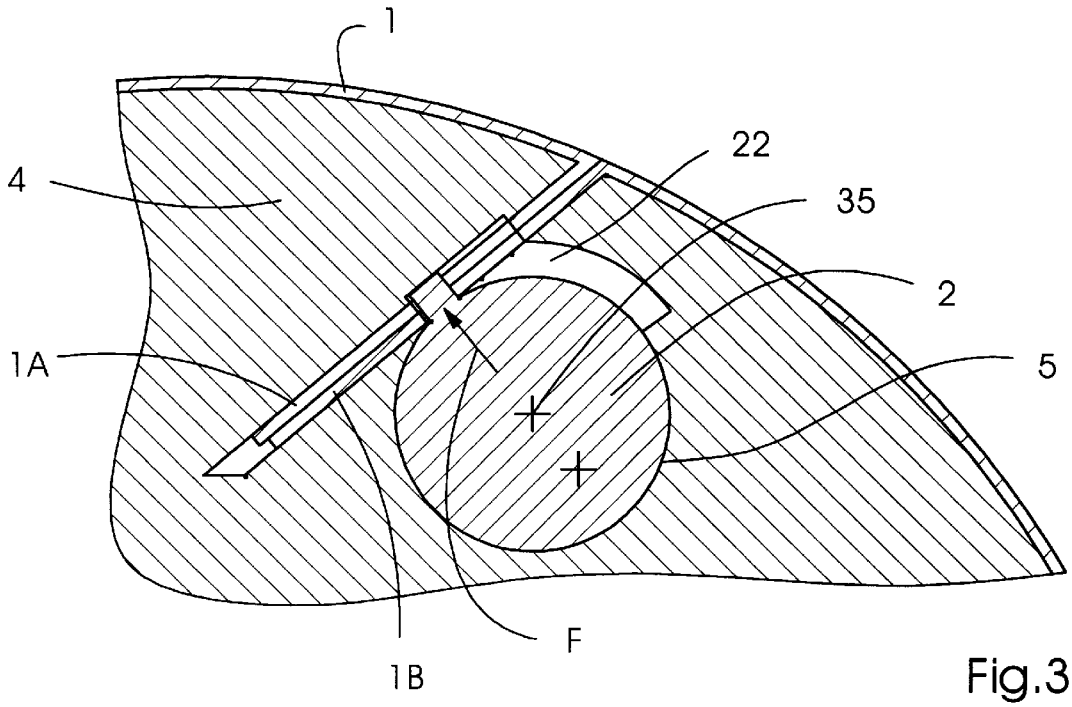
FIG. 3 shows partially another embodiment of the present invention.

FIG. 3 illustrates a second embodiment of the printing press in which a plate I having a lead edge 1A and a tail edge 1B situated on a plate cylinder 4. The plate cylinder 4 has a plate slot 3. The lead edge 1A and the tail edge 1B are situated in the plate slot 3. An eccentric shaft 2 has an eccentric axis 20 eccentric to a hole axis 35. The shaft 2 is disposed within a hole 5 of the plate cylinder 4, and is preferably disposed near the plate slot 3 having the lead and tail edges 1A, 1B. The hole has an extra cut-out section through which a finger 22 can move. As the eccentric shaft 2 is turned the finger 22 can catch the tail edge 1B and provide further friction for holding the plate 1 fast.

Figure 4:
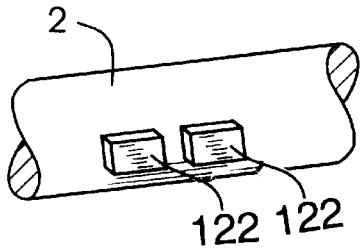
FIG. 4 shows a side view of an eccentric shaft of the present invention with a rectangular-shaped finger thereon.
Figure 5:
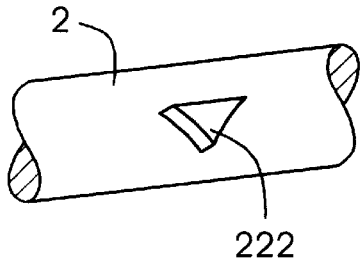
FIG. 5 shows a side view of an eccentric shaft of the present invention with a triangular-shaped finger thereon.
Figure 6:
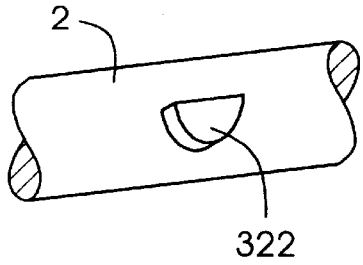
FIG. 6 shows a side view of an eccentric shaft of the present invention with a semi-circular shaped finger thereon.

FIGS. 4, 5 and 6 show various shapes for the fingers which are advantageous for aiding in holding the plate, including rectangular finger 122, triangular finger 222 and semi-circular finger 322, respectively. It should be noted that a plurality of the fingers may extend axially along the shaft 2. It is also possible that the shaft 2 in FIG. 1 be provided with a roughened surface.

It should be recognized that the shaft 2 may have a plurality of lock-downs to fix the shaft a various rotational locations to prevent any loss of grip and to ease installation of the plate on the plate cylinder. These lock-downs can be provided by clamps, additional eccentrics, an over-toggle or the like.

What is claimed is:

1. A printing press comprising:

a plate cylinder having an outer circumferential surface having an axially-extending slot therein, the slot having a first side and a second side, the plate cylinder having an axially-extending hole at least partially opening along the first side and having a hole axis;

a printing plate having a lead edge and a trail edge, the lead edge and trail edge located in the slot; and the plate cylinder having an eccentric shaft situated in the hole, the eccentric shaft for eccentric rotation with respect to the hole axis so as to selectively provide a force against at least one of the lead edge and the trail edge, the eccentric shaft including at least one finger located filed on a surface of the eccentric shaft and projecting therefrom, the at least one finger extending into the hole and catching the trail edge so as to provide friction for holding the printing plate.

2. The printing press as recited in claim 1 wherein each of the at least one finger is triangular shaped.

3. The printing press as recited in claim 1 wherein each of the at least one finger is rectangular shaped.

4. The printing press as recited in claim 1 wherein each of the at least one finger is semi-circular shaped.

5. The printing press as recited in claim 1 wherein the at least one finger includes a plurality of fingers.

6. The printing press as recited in claim 1 further comprising a wrench or tool attached to the eccentric shaft.

7. A plate cylinder for a printing press comprising:

an outer circumferential surface having an axially-extending slot therein, the slot having a first side and a second side, the plate cylinder having an axially-extending hole at least partially opening along the first side and having a hole axis; and an eccentric shaft situated in the hole, the eccentric shaft for eccentric rotation with respect to the hole axis so as to selectively provide a force against at least one of a lead edge and a trail edge of a printing plate, the eccentric shaft including at least one finger located filed on a surface of the eccentric shaft and projecting therefrom, the at least one finger extending into the hole and catching the trail edge so as to provide friction for holding the printing plate.

8. The plate cylinder as recited in claim 7 wherein each of the at least one finger is triangular shaped.

9. The plate cylinder as recited in claim 7 wherein each of the at least one finger is rectangular shaped.

10. The plate cylinder as recited in claim 7 wherein each of the at least one finger is semi-circular shaped.

11. The plate cylinder as recited in claim 7 wherein the at least one finger includes a plurality of fingers.

12. The plate cylinder as recited in claim 7 further comprising a wrench or tool attachable to the eccentric shaft.

* * * * *